US010003146B2

(12) United States Patent
Doi

(10) Patent No.: US 10,003,146 B2
(45) Date of Patent: Jun. 19, 2018

(54) ELECTRICAL CONNECTOR

(71) Applicant: HIROSE ELECTRIC CO., LTD., Tokyo (JP)

(72) Inventor: Kentaro Doi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days. days.

(21) Appl. No.: 15/666,754

(22) Filed: Aug. 2, 2017

(65) Prior Publication Data

US 2018/0048083 A1 Feb. 15, 2018

(30) Foreign Application Priority Data

Aug. 9, 2016 (JP) ..... 2016-156115

(51) Int. Cl.

| | |
|---|---|
| ***H01R 13/64*** | (2006.01) |
| ***H01R 12/71*** | (2011.01) |
| ***H01R 12/70*** | (2011.01) |
| ***H01R 13/502*** | (2006.01) |
| *H01R 107/00* | (2006.01) |
| *H01R 24/60* | (2011.01) |

(52) U.S. Cl.

CPC ..... *H01R 12/716* (2013.01); *H01R 12/707* (2013.01); *H01R 13/502* (2013.01); *H01R 24/60* (2013.01); *H01R 2107/00* (2013.01)

(58) Field of Classification Search

CPC ..... H01R 13/6315; H01R 13/631; H01R 13/748; H01R 13/743; H01R 12/57; H01R 2103/00

USPC ..... 439/246–248

See application file for complete search history.

(56) References Cited

U.S. PATENT DOCUMENTS 5,002,497 A * 3/1991 Plocek ..... H01R 13/6315 439/247
5,259,779 A * 11/1993 Ooya ..... H01R 13/6315 29/856
8,821,174 B2 * 9/2014 Kimura ..... H01R 13/6315 439/248

FOREIGN PATENT DOCUMENTS

JP 2006-216298 A 8/2006

* cited by examiner

*Primary Examiner* — Hien Vu

(74) *Attorney, Agent, or Firm* — Kubotera & Associates, LLC

(57) ABSTRACT

An electrical connector includes a terminal; a housing for holding the terminal; and a regulating metal member. The terminal includes a connecting portion to be connected to an electrical circuit board and a contact portion for contacting with a mating connecting member. The housing includes a fixed housing to be fixed to the electrical circuit board and a movable housing configured to be movable relative to the fixed housing. The regulating metal member is attached to the fixed housing, and includes a regulating portion for preventing the movable housing from abutting against the electrical circuit board. The terminal further includes an elastic portion configured to be capable of elastically deforming. The regulating portion is disposed to face or abut against a lower surface of the fixed housing. The movable housing includes a recessed portion in the lower surface thereof for accommodating the regulating portion.

4 Claims, 8 Drawing Sheets

ELECTRICAL CONNECTOR

BACKGROUND OF THE INVENTION AND RELATED ART STATEMENT

The present invention relates to an electrical connector to be mounted on an electrical circuit board. More specifically, the present invention relates to an electrical connector to be connected to a mating connecting member while the electrical connector is mounted on an electrical circuit board.

Patent Reference has disclosed a conventional electrical connector of a connector. When the conventional electrical connector is mounted on an electrical circuit board, the conventional electrical connector may be shifted from a standard position relative to the electrical circuit board. If the conventional electrical connector is shifted from the standard position relative to the electrical circuit board, when another connector as a mating connecting member is connected to the conventional electrical connector, the conventional electrical connector mounted on the electrical circuit board may receive a undesirably large stress. Even though the conventional electrical connector is mounted at the standard position on the electrical circuit board, if another connector as the mating connecting member is connected to the conventional electrical connector at a position shifted from a standard position, the conventional electrical connector mounted on the electrical circuit board may receive a undesirably large stress. Accordingly, it is desirable for the conventional electrical connector to be capable of floating to absorb the positional shift.

Patent Reference: Japanese Patent Publication No. 2006-216298

In the conventional electrical connector disclosed in Patent Reference and to be mounted on the electrical circuit board, the conventional electrical connector includes a fixed housing to be fixed to the electrical circuit board and a movable (floating) housing configured to be movable relative to the fixed housing. The conventional electrical connector further includes terminals arranged to bridge between the fixed housing and the movable housing. Each of the terminals includes an elastic portion in a curved shape. Accordingly, when the mating connecting member is connected to the movable housing, the movable housing is capable of being movable relative to the fixed housing. As a result, the conventional electrical connector is capable of being a floating electrical connector.

As described above, in the conventional electrical connector disclosed in Patent Reference capable of being the floating electrical connector, the movable housing is configured to be movable relative to the fixed housing. Accordingly, when the mating connecting member is connected to the movable housing from above with a large force, the movable housing may be moved excessively in a downward direction. As a result, a lower surface of the movable housing may contact with the electrical circuit board, and an electrical circuit portion and the like on the electrical circuit board may be damaged.

To this end, in the conventional electrical connector disclosed in Patent Reference, a position regulating member (a hold down member) formed of a durable material is attached to the fixed housing. Accordingly, it is possible to prevent the movable housing from contacting with the electrical circuit board, while the movable housing is capable of floating in the vertical direction. Further, a position regulating portion formed in a plate shape is disposed on the position regulating member to face the lower surface of the movable housing. Accordingly, when the mating connecting member is connected to the movable housing, even though the movable housing is moved downwardly, the position regulating portion restricts the movable housing from moving further downwardly before the movable housing contact with the electrical circuit board. As a result, it is possible to prevent the movable housing from contacting with the electrical circuit board.

In general, it has been required to reduce a size of the conventional electrical connector. More specifically, it is necessary to reduce a size (a height size) of the conventional electrical connector in a direction that the mating connecting member is connected to the conventional electrical connector (height reduction). Accordingly, when the mating connecting member mounted on another electrical circuit board is connected to the conventional electrical connector mounted on the electrical circuit board, it is possible to reduce a distance between the electrical circuit board and another electrical circuit board.

As described above, in the conventional electrical connector disclosed in Patent Reference, the position regulating portion of the position regulating member is disposed on the fixed housing, and is situated between the lower surface of the movable housing and the electrical circuit board. Accordingly, as a whole, the height size of the conventional electrical connector is inevitably increased by a sum of a plate thickness of the position regulating member and a space size between the position regulating portion and the fixed housing.

In the conventional electrical connector disclosed in Patent Reference, the movable housing is configured to have a minimum necessary height size. Accordingly, if it is tried to reduce the height size of the movable housing by the sum of the plate thickness of the position regulating member and the space size between the position regulating portion and the fixed housing, the movable housing may be deteriorated in term of strength thereof.

As described above, in the conventional electrical connector disclosed in Patent Reference, the position regulating member is provided for preventing the movable housing from contacting with the electrical circuit board. However, due to the position regulating member, it is difficult to reduce the height size of the conventional electrical connector.

In view of the problems described above, an object of the present invention is to provide an electrical connector capable of solving the problems of the conventional electrical connector. In the electrical connector of the present invention, it is possible to securely prevent a movable housing thereof from contacting with an electrical circuit board and also reduce a height size of the electrical connector while the movable housing of the electrical connector is capable of floating.

Further objects and advantages of the invention will be apparent from the following description of the invention.

SUMMARY OF THE INVENTION

In order to attain the objects described above, according to a first aspect of the present invention, a electrical connector is configured to be connected to an electrical circuit board.

According to the first aspect of the present invention, the electrical connector includes a terminal and a housing for holding the terminal. The terminal includes a connecting portion at one end portion thereof to be connected to the electrical circuit board, and a contact portion on the other end portion for contacting with a mating connecting member. The housing is formed of a fixed housing to be fixed to the electrical circuit board through the terminal, and a movable housing configured to be movable relative to the fixed housing. Further, the movable housing is a component separated from the fixed housing, and is configured to accommodate the contact portion of the terminal.

According to the first aspect of the present invention, the electrical connector further includes a regulating metal member disposed on the fixed housing. The regulating metal member includes a regulating portion for preventing a lower surface of the movable housing from contacting with the electrical circuit board.

According to the first aspect of the present invention, in the electrical connector, the terminal further includes a fixed side held portion, a movable side held portion, and an elastic portion. The fixed side held portion is held with the fixed housing, and the movable side held portion is held with the movable housing. The elastic portion is arranged to connect the fixed side held portion and the movable side held portion, and is configured to be capable of elastically deforming.

According to the first aspect of the present invention, in the electrical connector, the regulating metal member is arrange such that the regulating portion faces or abut against a portion of the lower surface of the movable housing. Further, the movable housing includes a recessed portion formed in the lower surface of the movable housing for accommodating at least a portion of the regulating portion in a vertical direction.

As described above, according to the first aspect of the present invention, the electrical connector includes the terminal having the elastic portion. Accordingly, it is possible for the movable housing to be capable of floating. Further, the regulating metal member is arrange such that the regulating portion faces or abut against the portion of the lower surface of the movable housing. Accordingly, when the movable housing is floating and is moved downwardly, the regulating portion of the regulating metal member restricts the movable housing at a specific position before the movable housing abuts against the electrical circuit board. As a result, it is possible to prevent the movable housing from abutting against the electrical circuit board.

Further, according to the first aspect of the present invention, in the electrical connector, the movable housing includes the recessed portion formed in the lower surface of the movable housing for accommodating at least the portion of the regulating portion in the vertical direction. Accordingly, it is possible to reduce a height size of the electrical connector. It should be noted that it is not necessary to form the recessed portion in an entire portion of the lower surface of the movable housing. Accordingly, it is possible to securely maintain a strength of the movable housing.

According to a second aspect of the present invention, in the electrical connector according to the first aspect, the regulating metal member may include a mounting portion to be connected to the electrical circuit board. When the regulating metal member includes the mounting portion, and the regulating metal member is mounted on the electrical circuit board with solder, it is possible to improve a strength against a force received from the movable housing when the regulating portion is supported.

According to a third aspect of the present invention, in the electrical connector according to the second aspect, the fixed housing may include a holding groove portion extending upwardly from the lower surface of the fixed housing. Further, the regulating metal member may include a fixed portion to be fitted in the holding groove portion. The fixed portion may include a cut portion for engaging with a corresponding protruding portion of the fixed housing when the mating connecting member is pulled out.

As described above, according to the third aspect of the present invention, in the electrical connector according to the first aspect, the regulating metal member includes the fixed portion to be fitted in the holding groove portion formed in the fixed housing. Accordingly, it is possible to directly attach the regulating metal member to the fixed housing. Further, the fixed portion includes the cut portion for engaging with the corresponding protruding portion of the fixed housing. Accordingly, when the mating connecting member is pulled out, the fixed housing strongly holds the regulating metal member, so that the fixed housing is not moved following the mating connecting member.

According to a fourth aspect of the present invention, in the regulating metal member of the electrical connector according to the third aspect, the fixed portion may be disposed at a plurality of positions situated away from the regulating portion. Further, the fixed housing may include a supporting groove portion extending upwardly from the lower surface of the fixed housing. Further, the regulating metal member may include a supported portion to be tightly fitted in or inserted into the supporting groove portion of the fixed housing. The supported portion is disposed at the same position as that of the regulating portion or a position overlapping with that of the regulating portion in a direction connecting base portions of a plurality of the fixed portions.

As described above, according to the fourth aspect of the present invention, in the regulating metal member of the electrical connector according to the third aspect, the supported portion is disposed at the same position as that of the regulating portion of the regulating metal member. Accordingly, when the movable housing is floating and the regulating portion receives a force from the movable housing, it is possible to improve strength of the regulating metal member against a torsion deformation due to bending within a range connecting the base portions of the fixed portions, especially at the regulating portion.

As described above, in the electrical connector according to the present invention, the movable housing is configured to be movable downwardly toward the electrical circuit board. The regulating portion of the regulating metal member is provided for restricting the movable housing from moving downwardly while the movable housing is capable of floating. Further, the recessed portion is formed in the lower surface of the movable housing for accommodating the regulating portion in the vertical direction. Accordingly, it is possible to reduce the height size of the electrical connector without lowering the strength of the movable housing.

BRIEF DESCRIPTION OF THE DRAWINGS

FIGS. 7(A) and 7(B) are perspective views showing a regulating metal member of the plug side connector (the first connector) according to the first embodiment of the present invention, wherein FIG. 7(A) is a perspective view showing the regulating metal member of the plug side connector viewed from one side thereof and FIG. 7(B) is a perspective view showing the regulating metal member of the plug side connector viewed from the other side thereof;

FIGS. 8(A) to 8(C) are sectional views showing a recessed portion and a regulating portion of the plug side connector (the first connector) according to the first embodiment of the present invention, wherein FIG. 8(A) is a sectional view showing the recessed portion and the regulating portion of the plug side connector before the recessed portion abuts against the regulating portion, FIG. 8(B) is a sectional view showing the recessed portion and the regulating portion of the plug side connector when the recessed portion abuts against the regulating portion without elastically deforming the regulating portion, and FIG. 8(C) is a sectional view showing the recessed portion and the regulating portion of the plug side connector when the recessed portion abuts against the regulating portion with elastically deforming the regulating portion.

DETAILED DESCRIPTION OF THE PREFERRED EMBODIMENTS

Figure 1:
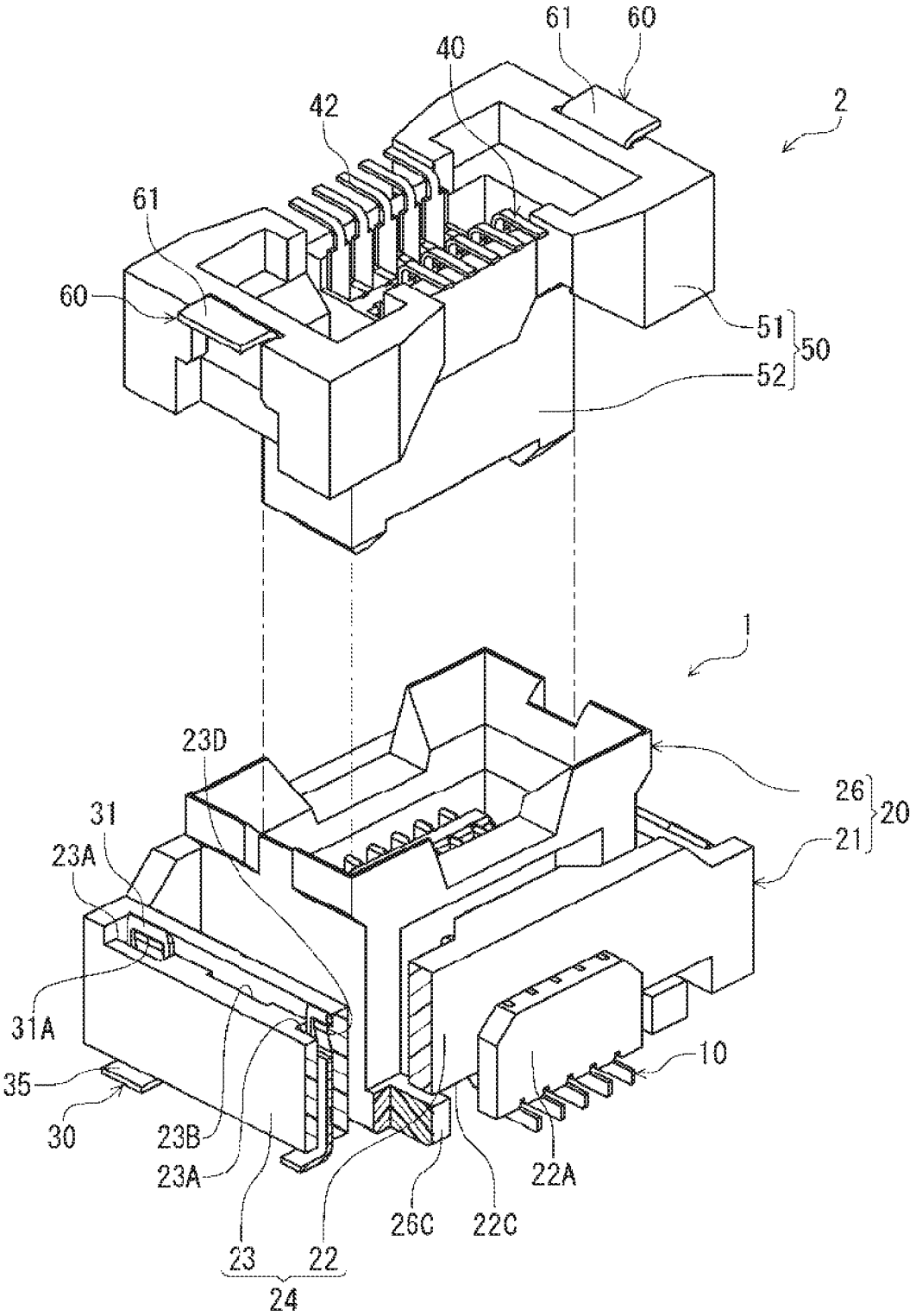
FIG. 1 is a perspective view showing a connector assembled member having a plug side connector (a first connector) and a receptacle side connector (a second connector) before the plug side connector is connected to the receptacle side connector (note that the first connector is shown as a partial sectional view) according to a first embodiment of the present invention.

Hereunder, embodiments of the present invention will be explained with reference to the accompanying drawings. In the accompanying drawings, similar components are designated with the same reference numerals, and repeated explanations thereof are omitted.

First Embodiment

A first embodiment of the present invention will be explained. FIG. 1 is a perspective view showing a connector assembled member having a plug side connector 1 (a first connector 1) and a receptacle side connector 2 (a second connector 2) before the plug side connector 1 is connected to the receptacle side connector 2 (note that the first connector 1 is shown as a partial sectional view) according to the first embodiment of the present invention.

Figure 2:
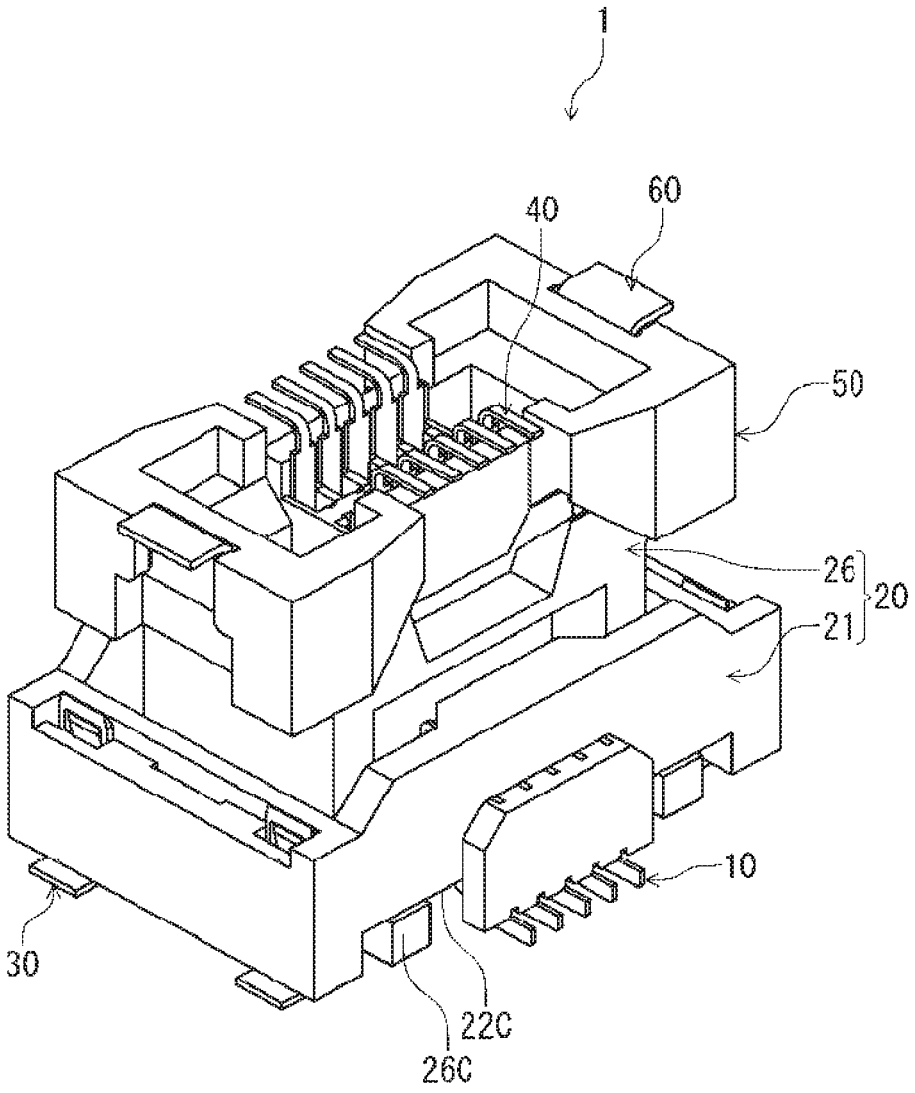
FIG. 2 is a perspective view showing the connector assembled member having the plug side connector (the first connector) and the receptacle side connector (the second connector) after the plug side connector is connected to the receptacle side connector according to the first embodiment of the present invention.

FIG. 2 is a perspective view showing the connector assembled member having the plug side connector 1 (the first connector 1) and the receptacle side connector 2 (the second connector 2) after the plug side connector 1 is connected to the receptacle side connector 2 according to the first embodiment of the present invention.

Figure 3:
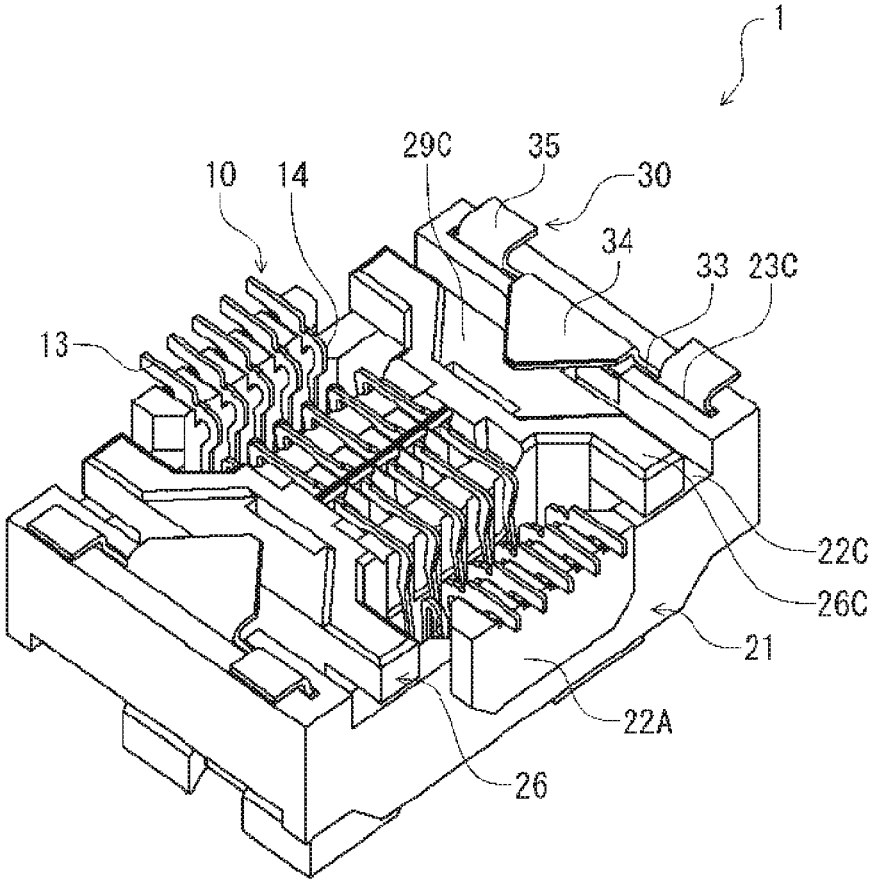
FIG. 3 is a perspective view showing the plug side connector (the first connector) of the connector assembled member in a state that the plug side connector is shown in an inverted posture from that shown in FIG. 1 according to the first embodiment of the present invention.

FIG. 3 is a perspective view showing the plug side connector 1 (the first connector 1) of the connector assembled member in a state that the plug side connector 1 is shown in an inverted posture from that shown in FIG. 1 according to the first embodiment of the present invention.

Figure 4:
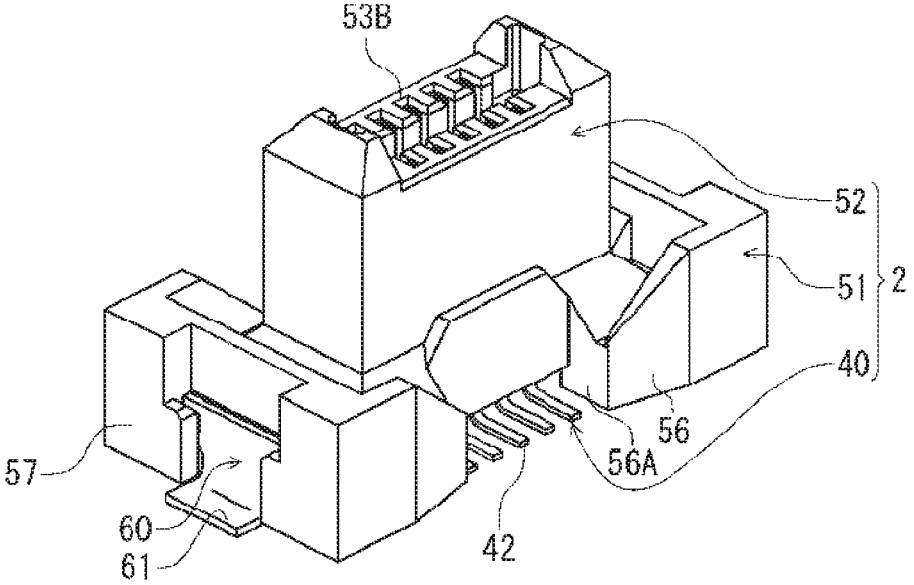
FIG. 4 is a perspective view showing the receptacle side connector (the second connector) of the connector assembled member in a state that the receptacle side connector is shown in an inverted posture from that shown in FIG. 1 according to the first embodiment of the present invention.

FIG. 4 is a perspective view showing the receptacle side connector 2 (the second connector 2) of the connector assembled member in a state that the receptacle side connector 2 is shown in an inverted posture that shown in FIG. 1 according to the first embodiment of the present invention.

Figure 5:
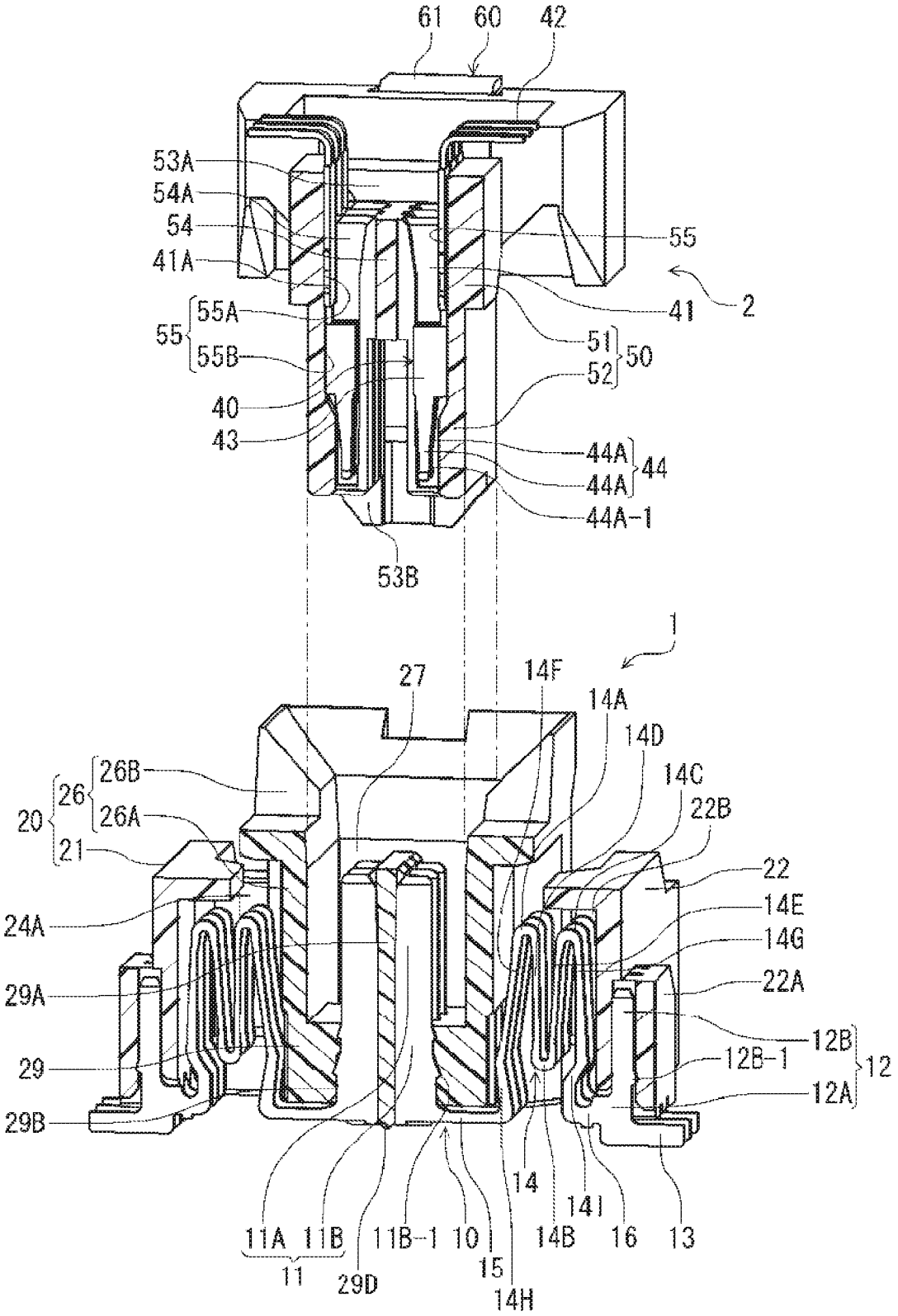
FIG. 5 is a sectional perspective view showing the connector assembled member having the plug side connector (the first connector) and the receptacle side connector (the second connector) before the plug side connector is connected to the receptacle side connector according to the first embodiment of the present invention.

FIG. 5 is a sectional perspective view showing the connector assembled member having the plug side connector 1 (the first connector 1) and the receptacle side connector 2 (the second connector 2) before the plug side connector 1 is connected to the receptacle side connector 2 according to the first embodiment of the present invention.

Figure 6:
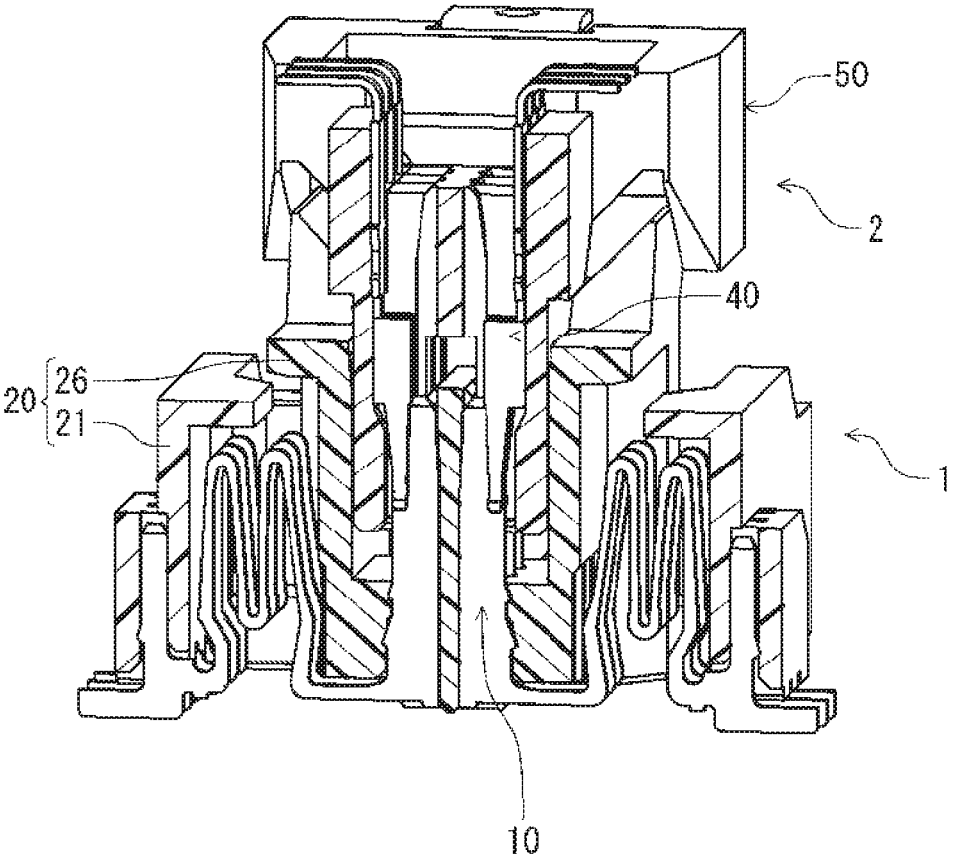
FIG. 6 is a sectional perspective view showing the connector assembled member having the plug side connector (the first connector) and the receptacle side connector (the second connector) after the plug side connector is connected to the receptacle side connector according to the first embodiment of the present invention.

FIG. 6 is a sectional perspective view showing the connector assembled member having the plug side connector 1 (the first connector 1) and the receptacle side connector 2 (the second connector 2) after the plug side connector 1 is connected to the receptacle side connector 2 according to the first embodiment of the present invention.

Figure 7A:
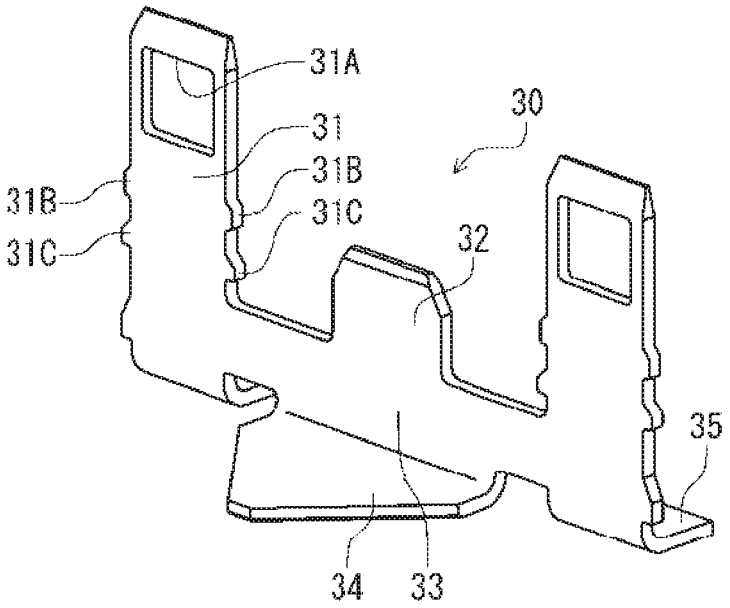
Figure 7B:
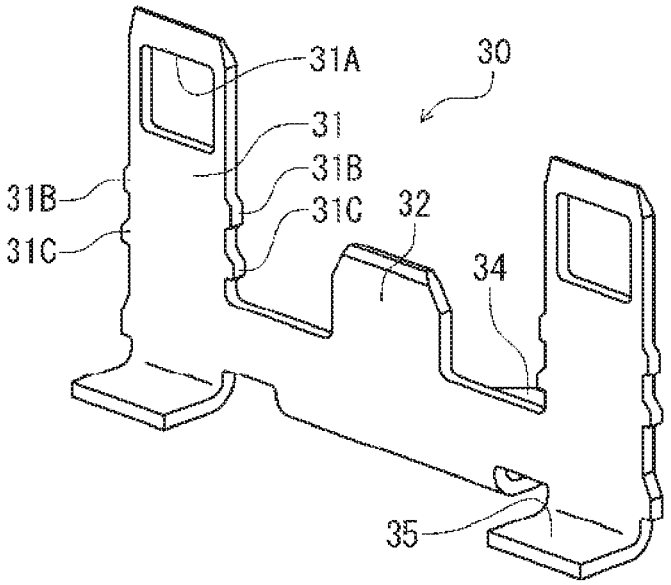

FIGS. 7(A) and 7(B) are perspective views showing a regulating metal member 30 of the plug side connector 1 (the first connector 1) according to the first embodiment of the present invention. More specifically, FIG. 7(A) is a perspective view showing the regulating metal member 30 of the plug side connector 1 viewed from one side thereof and FIG. 7(B) is a perspective view showing the regulating metal member 30 of the plug side connector 1 viewed from the other side thereof.

In the first embodiment, the first connector 1 includes first terminals 10 with the male type; a first housing 20 formed of an electrically insulation material for holding the first terminals 10; and the regulating metal member 30 held with the first housing 20. It should be noted that the terminals and the housing of the first connector 1 are designated with "first", and the terminals and the housing of the second connector 2 are designated with "second".

In the first embodiment, the first housing 20 includes a fixed housing 21 and a movable housing 26. The fixed housing 21 is configured to be attached to an electrical circuit board (not shown) through the first terminals 10. The movable housing 26 is configured to be movable relative to the fixed housing 21. In the first connector 1, the first housing 20 is formed in a substantially rectangular cubic shape extending in a longitudinal direction and a short side direction thereof along a plane parallel to the electrical circuit board. The first terminals 10 are arranged in two rows in the longitudinal direction of the first housing 20. Further, the first terminals 10 are arranged to face each other symmetrically in the short side direction (a connector width direction) perpendicular to the longitudinal direction.

In the first embodiment, the fixed housing 21 includes a side wall portion 22 standing vertically relative to the electrical circuit board and extending in the longitudinal direction. Further, the fixed housing 21 includes a edge wall portion 23 extending in the short side direction, so that the side wall portion 22 and the edge wall portion 23 form a surrounding wall portion 24. A central space 24A is formed inside the surrounding wall portion 24 to penetrate in the vertical direction, so that the movable housing 26 is accommodated in the central space 24A from above.

In the first embodiment, the side wall portion 22 includes protruding wall portions 22A on an outer wall surface thereof along with the longitudinal direction over a terminal arrangement range for holding the first terminals 10. Further, the side wall portion 22 includes fixed side recessed portions 22B on an inner wall surface thereof. The fixed side recessed portions 22B (refer to FIG. 5) are formed to open inwardly and downwardly, and constitute a part of accommodation space for accommodating an elastic portion of each of the first terminals 10 (described later). The protruding wall portions 22A and the fixed side recessed portions 22B will be explained in more detail later in accordance with the first terminals 10.

In the first embodiment, the side wall portion 22 of the fixed housing 21 has a lower surface situated above a lower surface of a bottom wall portion 29 of the movable housing 26 except the protruding wall portions 22A. As shown in FIGS. 1 and 5, the lower surface of the side wall portion 22 at both end portions (portions situated outside the terminal arrangement range) in the connector longitudinal direction constitutes a regulating surface 22C. The regulating surface 22C is situated above a regulated protruding portion 26C of the movable housing 26 (described later). When the regulating surface 22C abuts against the regulated protruding portion 26C, the regulating surface 22C regulates the movable housing 26 from moving upwardly (in the connector pulling out direction) and the first terminals 10 from elastically deforming upwardly within a specific range.

In the first embodiment, the regulating metal member 30 is held with the edge wall portion 23 of the fixed housing 21 within a thickness of the edge wall portion 23. When an attachment piece 32 (described later) with a leg piece shape formed on the regulating metal member 30 is tightly fixed to the electrical circuit board with solder, the fixed housing 21 is fixed to the electrical circuit board (not shown) through not only the first terminals 10 but also the regulating metal member 30.

In the first embodiment, the edge wall portion 23 of the fixed housing 21 includes a holding groove portion 23A within the thickness of the edge wall portion 23 for holding a fixed portion 31 of the regulating metal member 30 (described later). The holding groove portion 23A is disposed at two locations separated from each other in the connector width direction, and is formed in a slit hole shape penetrating in the vertical direction.

In the first embodiment, the edge wall portion 23 of the fixed housing 21 further includes a supporting groove portion 23B between the holding groove portions 23A for supporting a supported portion 32 of the regulating metal member 30 (described later). The supporting groove portion 23B is formed in a slit hole shape penetrating in the vertical direction.

In the first embodiment, a protruding portion 23D is formed on an inner surface of the holding groove portions 23A for engaging with a cut portion 31A with a window shape formed in the regulating metal member 30 (described later). Further, the edge wall portion 23 of the fixed housing 21 includes a lateral groove portion 23C in the bottom surface thereof. The lateral groove portion 23C is configured to communicate with the holding groove portions 23A and a supporting groove portion 23B situated between the holding groove portions 23A.

In the first embodiment, the movable housing 26 is configured to be movable relative to the fixed housing 21 through the elastic deformation of an elastic portion 14 of the first terminal 10 (described later). As shown in FIG. 5, the movable housing 26 includes a penetrating portion 26A and a protruding portion 26B. The penetrating portion 26A is situated in the central space 24A of the fixed housing 21 to penetrate through the central space 24A. The protruding portion 26B is formed to protrude upwardly from the central space 24A.

In the first embodiment, the movable housing 26 further includes a receiving recessed portion 27 in a range from the protruding portion 26B to the penetrating portion 26A. The receiving recessed portion 27 is formed to open upwardly for accommodating the second connector 2 as the mating connecting member or a mating connector. A central protruding wall portion 29A is disposed in the receiving recessed portion 27 to stand from the bottom wall portion 29 of the movable housing 26 for holding the first terminals 10. Further, a movable side recessed portion 26D is formed in an outer surface of the penetrating portion 26A of the movable housing 26. The movable side recessed portion 26D is formed to open downwardly and face the fixed side recessed portion 22B of the fixed housing 21.

In the first embodiment, together with the fixed side recessed portion 22B, the movable side recessed portion 26D constitutes an accommodating space 20A for accommodating the elastic portions 14 of the first terminals 10. More specifically, the central protruding wall portion 29A of the movable housing 26 is provided for holding the first terminals 10. It should be noted that it is not necessary to provide the central protruding wall portion 29A. Alternatively, instead of providing the central protruding wall portion 29A, it may be configured such that only a movable side column portion 11 of the first terminal 10 (described later) stands in the receiving recessed portion 27.

As shown in FIG. 5, the movable housing 26 further includes the regulated protruding portion 26C (refer to FIG. 1 as well). The regulated protruding portion 26C is formed in a rectangular column shape and extends outwardly in the connector width direction from a lower end portion of the movable housing 26 at both end portions thereof in the connector longitudinal direction (outside the terminal arrangement range). The regulated protruding portion 26C extends up to a range of the side wall portion 22 of the fixed housing 21 in the connector width direction. Further, the regulated protruding portion 26C includes a distal end portion situated below a flat lower surface of an end portion of the side wall portion 22 (corresponding to the regulating surface 22C described above).

As shown in FIG. 1 and FIG. 5, when the elastic portions 14 of the first terminals 10 are in a free state, a flat upper surface of the regulated protruding portion 26C is situated away from the regulating surface 22C of the side wall portion 22 with a space in between. When the elastic portion 14 is elastically deformed and the movable housing 26 is moved upwardly, the regulated protruding portion 26C abuts against the regulating surface 22C of the side wall portion 22. Accordingly, the first terminals 10 are restricted from being elastically deformed and the movable housing 26 is restricted from being moved within a specific range. In other words, the regulating surface 22C of the fixed housing 21 and the regulated protruding portion 26C of the movable housing 26 constitute a first regulating portion for restricting the first terminals 10 from being deformed upwardly within a specific range (a limit) when the regulating surface 22C of the fixed housing 21 abuts against the regulated protruding portion 26C of the movable housing 26.

In the first embodiment, the upper surface of the regulated protruding portion 26C and the regulating surface 22C are formed to have entirely flat surfaces, and the flat surfaces abut against each other. It should be noted that the upper surface of the regulated protruding portion 26C and the regulating surface 22C are not limited to have the flat surfaces. Alternatively, one of the upper surface of the regulated protruding portion 26C and the regulating surface 22C may include a protruding portion, so that the protruding portion abuts against the other of the upper surface of the regulated protruding portion 26C and the regulating surface 22C.

As shown in FIG. 3, the movable housing 26 further includes a recessed portion 29C in a lower surface of the bottom wall portion 29 (shown as an upper surface in FIG. 3) at both end portions thereof in the connector longitudinal direction. The recessed portion 29C is formed in a substantially trapezoid shape in a plan view, so that the recessed portion 29C is provided for accommodating at least a portion of a plate thickness of a regulating portion 34 with a plate shape of the regulating metal member 30 (described later).

As shown in FIG. 3(A), when the elastic portions 14 of the first terminals 10 are in the free state, a lower surface of the recessed portion 29C for accommodating the regulating portion 34 is situated away from the regulating portion 34 of the regulating metal member 30 with a space in between. When the elastic portions 14 are elastically deformed and the movable housing 26 is moved downwardly, the recessed portion 29C abuts against the regulating portion 34. Accordingly, the movable housing 26 is moved and the first terminals 10 are elastically deformed downwardly, so that at least the portion of the plate thickness of the regulating portion 34 is maintained within a specific range.

As shown in FIG. 5, a lower protruding portion 29D is disposed on the lower surface of the bottom wall portion 29 of the movable housing 26. The lower protruding portion 29D is arranged to protrude downwardly at a central portion in the connector width direction, and to extend over an entire range of the terminal arrangement range in the connector longitudinal direction.

As shown in FIG. 5, the first terminal 10 as a male terminal is formed of a metal plate member maintaining a flat surface. The first terminals 10 have an identical shape and are arranged in a pair to face each other in the connector width direction, so that the first terminals 10 are symmetrical in the connector width direction. Further, the first terminals 10 are arranged in a plurality of rows in the connector longitudinal direction. As described above, one pair of the first terminals 10 is arranged symmetrically in the connector width direction, and both have the identical shape. It should be noted that, in the following description, one of the first terminals 10 (the one situated on the right side in FIG. 5) will be explained in more detail.

In the first embodiment, the first terminal 10 includes a movable side column portion 11; a fixed side column portion 12; a connecting portion 13; and the elastic portion 14. The movable side column portion 11 is disposed to stand at a position close to the second terminal 40 as the mating terminal facing each other in the connector width direction. Further, the movable housing 26 is configured to hold the movable side column portion 11. The fixed side column portion 12 is situated to stand at a position opposite to that of the movable side column portion 11 in the connector width direction. The connecting portion 13 is configured to extend from a lower edge of the fixed side column portion 12. The elastic portion 14 is situated between the movable side column portion 11 and the fixed side column portion 12. It should be noted that the movable side column portion 11, the fixed side column portion 12, the connecting portion 13, and the elastic portion 14 are integrated.

In the first embodiment, the movable side column portion 11 includes a contact portion 11A at an upper half portion thereof for contacting with the second terminal 40 with the female type of the second connector 2. Further, the movable side column portion 11 includes a movable side held portion 11B at a lower portion thereof to be held with the movable housing 26. The contact portion 11A is chamfered at a distal end portion (an upper end portion) thereof, so that the first terminal 10 is easily inserted into the second terminal 40. The movable side held portion 11B includes an engaging protruding portion 11B-1 on a side edge portion thereof for engaging with the movable housing 26.

As shown in FIG. 5, a holding groove portion 29B is formed in the bottom wall portion 29 of the movable housing 26, so that the movable side held portion 11B is tightly fitted into the holding groove portion 29B from below. When the movable side held portion 11B is tightly fitted into the holding groove portion 29B from below, the engaging protruding portion 11B-1 bites a corresponding inner surface of the holding groove portion 29B, so that the engaging protruding portion 11B-1 tightly engages with the movable housing 26.

In the first embodiment, the fixed side column portion 12 includes a base portion 12A at a lower portion thereof and a fixed side held portion 12B at an upper portion thereof above the base portion 12A. The fixed side held portion 12B includes an engaging protruding portion 12B-1 for engaging with the fixed housing 21. A holding groove portion 22A-1 is formed in the protruding wall portion 22A protruding from the outer surface of the side wall portion 22 of the fixed housing 21 to penetrate in the vertical direction, so that the fixed side held portion 12B is tightly fitted into the holding groove portion 22A-1 from below. When the fixed side held portion 12B is tightly fitted into the holding groove portion 22A-1 from below, the engaging protruding portion 12B-1 bites a corresponding inner surface of the holding groove portion 22A-1, so that the engaging protruding portion 12B-1 tightly engages with the fixed housing 21.

In the first embodiment, the connecting portion 13 is disposed to extend from the lower end portion of the base portion 12A of the fixed side column portion 12. Further, the connecting portion 13 is disposed to extend in a lateral direction along the lower surface of the fixed housing 21 and outwardly outside the fixed housing 21.

As described above, in the first embodiment, the first terminal 10 includes the elastic portion 14 situated at a position between the movable side held portion 11B and the fixed side held portion 12B. The elastic portion 14 extends in the left direction such that the elastic portion 14 is connected to the movable side held portion 11B through a movable side transition portion 15 extending in the lateral direction from the lower end portion of the movable side held portion 11B. Further, the elastic portion 14 extends in the right direction such that the elastic portion 14 is connected to the fixed side held portion 12B through a fixed side transition portion 16 extending in the lateral direction from the base portion 12A below the fixed side held portion 12B.

In the first embodiment, the elastic portion 14 is formed of one single band member with a substantially M character shape rising from the movable side transition portion 15 and the fixed side transition portion 16. More specifically, the elastic portion 14 is formed of one single band member with a substantially M character shape having a width smaller than that of the movable side held portion 11B and the fixed side held portion 12B.

In the first embodiment, the elastic portion 14 includes two bent portions 14A and 14C having a curved shape at an upper portion thereof and one bent portion 14B having a curved shape at a lower portion thereof. Further, the elastic portion 14 includes an inner side straight portion 14D connecting the bent portion 14A and the bent portion 14B; an inner side straight portion 14E connecting the bent portion 14C and the bent portion 14B; and outer side straight portions 14E and 14G extending from the bent portion 14A and the bent portion 14C, respectively.

As described above, in the first embodiment, the elastic portion 14 is formed in the substantially M character shape, that is, a continuous wave shape formed of three wave shape portions, in which one wave shape portion with a U character shape is disposed between two wave shape portions with an inverted U character shape. Accordingly, the elastic portion 14 is capable of elastically deforming. It should be noted that each of the three wave shape portions has the bent portion and the straight portion. Further, in the three wave shape portions, each of the straight portions 14D, 14E, 14F, and 14G forms a widening portion inclined such that an opening width of the wave shape is increasing away from each of the bent portions 14A, 14B, and 14C, respectively.

In the first embodiment, among the three wave shape portions, the wave shape portion situated on the left side includes an inclined portion 14H. The inclined portion 14H is arranged to extend downwardly from the outer side straight portion 14F, and is inclined outwardly and inwardly (the right side in FIG. 5) at a lower portion thereof below the bent portion 14B in the vertical direction. Further, the wave shape portion situated on the right side includes an inclined portion 14I. The inclined portion 14I is arranged to extend downwardly from the outer side straight portion 14G, and is inclined outwardly and inwardly (the right side in FIG. 5) at a lower portion thereof below the bent portion 14B in the vertical direction. The inclined portion 14H and the inclined portion 14I are inclined downwardly and inwardly, so that a distance between the inclined portion 14H and the inclined portion 14I is decreased in the lower range below the bent portion 14B at the lower portion.

As shown in FIG. 3 and FIGS. 7(A) and 7(B), especially in FIGS. 7(A) and 7(B), the regulating metal member 30 is formed of a metal plate member bent in a plate thickness direction thereof. The regulating metal member 30 includes a fixed portion 31, a supported portion 32, a lateral portion 33, a regulating portion 34, and a mounting portion 35. The fixed portion 31 is formed in an arm shape, and is tightly fitted in a holding groove portion 23A formed in the edge wall portion 23 of the fixed housing 21. The supported portion 32 is arranged to be tightly fitted in or inserted into the supporting groove portion 23A. The lateral portion 33 is arranged to be inserted into the lateral groove portion 23C. The regulating portion 34 is curved from the lateral portion 33, and is accommodated in the recessed portion 29C of the movable housing 26. The mounting portion 35 is configured to be attached to the electrical circuit board (not shown) with solder.

As shown in FIG. 3 and FIGS. 7(A) and 7(B), especially in FIGS. 7(A) and 7(B), the regulating metal member 30 is formed of a metal plate member bent in a plate thickness direction thereof. The regulating metal member 30 includes a fixed portion 31, a supported portion 32, a lateral portion 33, a regulating portion 34, and a mounting portion 35. The fixed portion 31 is formed in an arm shape, and is tightly fitted in a holding groove portion 23A formed in the edge wall portion 23 of the fixed housing 21. The supported portion 32 are arranged to be tightly fitted in or inserted into the supporting groove portion 23A. The lateral portion 33 is arranged to be inserted into the lateral groove portion 23C. The regulating portion 34 is curved from the lateral portion 33, and is accommodated in the recessed portion 29C of the movable housing 26. The mounting portion 35 is configured to be attached to the electrical circuit board (not shown) with solder.

As shown in FIGS. 7(A) and 7(B), the fixed portion 31, the supported portion 32, and the lateral portion 33 are situated on one vertical standing plane. More specifically, the fixed portion 31 is configured to extend upwardly from both end portions of the lateral portion 33. Further, the supported portion 32 is configured to extend upwardly from a central position between the fixed portions 31.

In the first embodiment, the fixed portion 31 is configured to extend to a position higher than that of the supported portion 32. Further, the fixed portion 31 includes a cut portion 31A having a window shape at an upper portion thereof. It should be noted that the cut portion 31A is preferable to have the window shape. Alternatively, as long as the cut portion 31A has an upper frame portion, the cut portion 31A may not be provided with one of side frame portions.

In the first embodiment, the fixed portion 31 further includes engaging protruding portions 31B and 31C on side edge portions thereof. Further, the fixed portion 31 includes an upper edge portion having a tapered shape in a plate thickness direction and a width direction thereof, so that the fixed portion 31 can be easily fitted in the holding groove portion 23A.

In the first embodiment, the lateral portion 33 is arranged to connect the fixed portions 31 at lower portions of the fixed portions 31. The supported portion 32 is configured to extend upwardly from the central position of the lateral portion 33 in the lateral direction thereof. Similar to the fixed portion 31, the supported portion 32 includes an upper edge portion having a tapered shape in a plate thickness direction and a width direction thereof, so that the supported portion 31 can be easily inserted into the supporting groove portion 23B.

In the first embodiment, the regulating portion 34 is disposed at a central position in the lateral direction of the lateral portion 33. The regulating portion 34 has a base portion having a larger width than that of the supported portion 32. Further, the regulating portion 34 is arranged to be curved and extend in a direction perpendicular to the lateral portion 33. The regulating portion 34 is formed in a substantially triangular shape having a width decreasing from the base portion at a curved section thereof to a distal end portion.

In the first embodiment, the fixed portion 31 is situated at the both end portions of the lateral portion 33 in the width direction thereof. The mounting portion 35 is arranged to extend from a lower edge of the fixed portion 31 in a direction opposite to the regulating portion 34.

In the first embodiment, the fixed portions 31 of the regulating metal member 30 are inserted into the holding groove portions 23A of the fixed housing 21 from the side of the bottom surface of the fixed housing 21, that is, from below in FIG. 1 and from above in FIG. 3. Further, the supported portion 32 of the regulating metal member 30 is inserted into the supporting groove portion 23B, and the lateral portion 33 of the regulating metal member 30 is inserted into the lateral groove portion 23C, so that the regulating metal member 30 is attached to the fixed housing 21.

In the first embodiment, when the regulating metal member 30 is attached to the fixed housing 21, the engaging protruding portions 31B and 31C of the fixed portion 31 bit into the inner surface of the holding groove portion 32A. Accordingly, the regulating metal member 30 is attached to the fixed housing 21 at a specific attachment position, so that the regulating metal member 30 does not come off. Further, when the regulating metal member 30 is attached to the fixed housing 21, the regulating portion 34 faces the bottom surface of the recessed portion 39C with a space in between.

In the first embodiment, the mounting portion 35 is situated to face the lower surface of the edge wall portion 23 of the fixed housing 21. Accordingly, it is possible to mount the mounting portion 35 on the electrical circuit board with solder.

In the first embodiment, the regulating portion 34 is configured such that an entire flat surface of the regulating portion 34 abuts against the recessed portion 29C of the movable housing 26. It should be noted that the regulating portion 34 is not necessarily formed entirely in the flat surface. Alternatively, the regulating portion 34 may include a local protruding portion on an upper surface thereof on the side of the recessed portion 29C. In this case, the recessed portion 29C includes a local step recessed portion recessed further inside at a position corresponding to the local protruding portion. Accordingly, when the regulating portion 34 abuts against the recessed portion 29C of the movable housing 26, the local protruding portion of the regulating portion 34 is accommodated in the local step recessed portion of the recessed portion 29C.

As described above, in the first embodiment, it is configured such that the first terminal 10 is restricted from elastically deforming within the elastic deformation range in the vertical direction between the upper limit and the lower limit. The first regulating portion (the regulating surface 22C of the fixed housing 21 and the regulated protruding portion 26C of the movable housing 26) defines the upper limit, and the second regulating portion (the regulating portion 34 of the regulating metal member 30 and the recessed portion 29C of the movable housing 26).

In the first embodiment, the elastic deformation range of the first terminal 10 in the vertical direction is set such that a spring force of the elastic portion 14 within the elastic deformation range becomes smaller than a holding force between the contact portion 11A of the first terminal 10 and a contact portion 44A of the second terminal 40 of the second connector 2 (described later) through friction in between in the connector pulling out direction when the first connector 1 is connected to the second connector 2. In other words, within the elastic deformation range, it is configured such that the spring force of the elastic portion 14 at a maximum deformation amount (referred to as a maximum spring force) becomes smaller than the holding force.

As shown in FIGS. 1, 2, 3, 4, 5, and 6, the second connector 2 includes the second terminals 40 with the female type; a second housing 50 formed of an electrically insulation material for holding the second terminals 40; and an attachment metal member 60 held with the second housing 50. The second housing 50 is fixed to an electrical circuit board (not shown) through the second terminals 40.

In the first embodiment, the second housing 50 is formed in a substantially rectangular cubic shape such that a longitudinal direction and a short side direction thereof are aligned with the longitudinal direction and the short side direction of the first housing 20 of the first connector 1. The second terminals 40 are arranged in two rows in the longitudinal direction of the second housing 50. Further, the second terminals 40 are arranged to face each other in the short side direction (the connector width direction) perpendicular to the longitudinal direction. It should be noted that in FIGS. 1, 2, 5 and 6, the second connector 2 is illustrated such that the second connector 2 faces the first connector 1 in the connector connecting direction, and in FIG. 4, only the second connector 2 is illustrated such that the second connector 2 is inverted in the vertical direction.

In the first embodiment, the second housing 50 of the second connector 2 as the mating connector of the first connector 1 includes an attachment block portion 51 and a fitting block portion 52. The attachment block portion 51 is configured to be attached to the electrical circuit board (not shown). The fitting block portion 52 is configured to protrude from the attachment block portion 51 in the connector connecting direction relative to the first connector 1. The attachment block portion 51 and the fitting block portion 52 are formed in substantially rectangular cubic shapes such that a longitudinal direction and a short side direction thereof are aligned with the longitudinal direction and the short side direction of the first housing 20 of the first connector 1.

As shown in FIGS. 1 and 5, the second housing 50 includes an upper recessed portion 53A at an upper portion thereof and a lower recessed portion 53B at a lower portion thereof at a central portion of the attachment block portion 51 viewed from above. The lower recessed portion 53B has a width smaller than that of the upper recessed portion 53A and a depth greater than that of the upper recessed portion 53A. Further, the second housing 50 includes a central wall portion 54 at a location between the upper recessed portion 53A and the lower recessed portion 53B. Further, the second housing 50 includes a terminal groove portion 55 arranged to extend along inner surfaces of the upper recessed portion 53A and the lower recessed portion 53B, and to penetrate through the central wall portion 54. The second terminal 40 is tightly fitted into the terminal groove portion 55 (described later).

As shown in FIG. 4, the attachment block portion 51 includes a side wall portion 56 extending in the longitudinal direction thereof, and a recessed wall portion 56A is formed in an outer surface of the side wall portion 56 at a central portion thereof in the longitudinal direction. The recessed wall portion 56 is recessed in the short side direction. A connecting portion 42 of the second terminal 40 is situated in the recessed wall portion 56A (described later), so that the connecting portion 42 is easily fixed to the electrical circuit board with solder. It should be noted that, with the recessed wall portion 56A, it is also possible to visually confirm the connection of the connecting portion 42 to the electrical circuit board.

In the first embodiment, the second housing 50 further includes an edge wall portion 57. The attachment metal member 60 with an L character shape is disposed on an outer surface of the edge wall portion 57. The attachment metal member 60 includes an attachment piece 61 extending outwardly in the connector longitudinal direction, so that the second housing 50 is tightly fixed to the electrical circuit board with solder. It should be noted that it is not necessary to provide the attachment metal member 60 for attaching the second housing 50 to the electrical circuit board. When it is possible to securely attach the second terminals 40 to the electrical circuit board with solder, it is not necessary to provide the attachment metal member 60.

As shown in FIG. 5, which illustrates the state before the first connector 1 is connected to the second connector 2, the second terminal 40 as the female terminal is formed of a metal band member bent in a thickness direction thereof. Further, similar to the first terminals 10, the second terminals 40 have an identical shape and are arranged in a pair to face each other in the connector width direction, so that the second terminals 40 are symmetrical in the connector width direction. Further, the second terminals 40 are arranged in a plurality of rows in the connector longitudinal direction.

As shown in FIG. 5, one pair of the second terminals 40 is illustrated in a state that the second terminals 10 are pulled out from the second housing 50. As described above, the second terminals 40 arranged symmetrically have an identical shape, and one of the second terminals 40 (situated on the right side in FIG. 5) will be explained in more detail in the following description.

In the first embodiment, the second terminal 40 includes a held portion 41 with a flat band shape; the connecting portion 42; an intermediate base portion 43; and a contact portion 44. The held portion 41 is situated at a center portion of the second terminal 40 and has a plate surface extending in a direction perpendicular to the plate surface of the first terminal 10. The connecting portion 42 is configured to bend in a direction perpendicular to the plate surface of the held portion 41 at an upper end side above the held portion 41. The intermediate base portion 43 is situated at an intermediate location below the held portion 41 and has a U character sectional shape. The contact portion 44 is formed of a pair of contact pieces 44A at a location below the intermediate base portion 43 and extending in a finger shape.

In the first embodiment, the held portion 41 is formed in the flat band shape. Further, the held portion 41 includes an engaging protruding portion 41A on both side edges thereof, so that the engaging protruding portion 41 bits in a corresponding surface of the terminal groove portion 55 of the second housing 50.

In the first embodiment, the intermediate base portion 43 is connected to the held portion 41 through a joining portion 45 having a narrow portion. Further, the intermediate base portion 43 includes a bottom surface portion and a side surface portion. The bottom surface portion is arranged to extend from a plate surface of the held portion 41, and is formed in a plate shape. The side surface portion is arranged to extend from both edge portions of the bottom surface portion in a direction perpendicular to the plate surface of the bottom surface portion. Further, the side surface portion is situated at two locations (the front side and the rear side in FIG. 5 relative to the sheet surface). It should be noted that the bottom surface portion and the side surface portions on the both edge portions of the bottom surface portion are arranged to form a U character shape.

As described above, in the first embodiment, the contact portion 44 is formed of a pair of contact pieces 44A. The contact pieces 44A are arranged to extend from a lower edge of the side surface portion on both sides of the intermediate base portion 43 in a finger shape. Further, the contact pieces 44A are arranged to face each other in a direction perpendicular to the sheet surface of FIG. 5. Further, the contact pieces 44A are inclined such that a distance between the contact pieces 44A is decreasing downwardly. Accordingly, the contact pieces 44A are arranged to approach to each other downwardly. The contact pieces 44A are arranged such that the distance between the contact pieces 44A becomes a minimum at lower end portions thereof, and the distance is increased one more time toward the lower end portions thereof.

In the first embodiment, a throat portion 44A-1 is formed at a location where the distance between the contact pieces 44A becomes a minimum. The distance between the contact pieces 44A at the throat portion 44A-1 is smaller than the plate thickness of the contact portion 11A of the first terminal 10. Accordingly, the contact pieces 44A sandwich the contact portion 11A at the throat portion 44A-1, so that the contact pieces 44A elastically contact with the contact portion 11A.

As shown in FIGS. 1, 2, 5, and 6, the second terminal 40 having the configuration described above is tightly fitted into the terminal groove portion 55 of the second housing 50 from above. Please note that, in FIG. 4, the second connector 2 is illustrated in the state inverted in the vertical direction from that shown in FIGS. 1, 2, 5, and 6. Accordingly, in FIG. 4, the second terminal 40 is tightly fitted into the terminal groove portion 55 of the second housing 50 from below.

As described above, the second terminal 40 is tightly fitted into the terminal groove portion 55 of the second housing 50 from above in FIG. 5. As shown in FIG. 5, a rectangular cylindrical hole portion 54A is formed in the central wall portion 54 to penetrate there through in the vertical direction. The rectangular cylindrical hole portion 54A is formed to have an inner circumferential shape corresponding to an outer circumferential shape of the intermediate base portion 43 having the U character sectional shape. Accordingly, the intermediate base portion 43 is capable of passing through the rectangular cylindrical hole portion 54A.

In the first embodiment, a groove portion 55A is formed in inner wall surfaces of the rectangular cylindrical hole portion 54A and the upper recessed portion 53A. The groove portion 55A is formed to have a depth corresponding to the plate thickness of the held portion 41, so that the groove portion 55A accommodates the contact portion 44 formed in the flat band shape and situated at the inner wall surface of the upper recessed portion 53A after the intermediate base portion 43 having the U character sectional shape passes through the rectangular cylindrical hole portion 54A of the central wall portion 54. When the held portion 41 is fitted into the groove portion 55A, the engaging protruding portion 41A of the held portion 41 bites into the inner surface of the groove portion 55A. Accordingly, it is possible to hold the second terminal 40 with the second housing 50 and prevent the second terminal 40 from coming off.

In the first embodiment, a groove portion 55B is formed in an inner wall surface of the lower recessed portion 53B below the central wall portion 54 (above the central wall portion 54 in FIG. 4). The groove portion 55B accommodates the intermediate base portion 43 and the contact portion 44 when the second terminal 40 is tightly fitted into a specific location. The groove portion 55B is formed to have a groove bottom surface for contacting with or being away from the bottom surface portion of the intermediate base portion 43, and a groove side surface for being away from the side surface portion of the intermediate base portion 43. Further, the groove portion 55B is formed to have a space so that the contact pieces 44A of the contact portion 44 are capable of elastically deforming in the space.

A using operation of the electrical connector for the electrical circuit board will be explained next with reference to FIGS. 1, 5, and 6.

First, the first connector 1 and the second connector 2 are fixed to the corresponding electrical circuit boards (not shown) with solder. More specifically, the first connector 1 is fixed to the corresponding electrical circuit board with solder through the connecting portion 13 of the first terminal 10 and the regulating metal member 30, and the second connector 2 is fixed to the corresponding electrical circuit board with solder through the connecting portion 42 of the second terminal 40 and the attachment metal member 60, so that the first connector 1 and the second connector 2 are fixed to the corresponding electrical circuit boards. It should be noted that although the electrical circuit boards are not shown in FIGS. 1, 5, and 6, the first connector 1 is attached to the electrical circuit board at the lower surface thereof, and the second connector 2 is attached to the electrical circuit board at the upper surface thereof.

As shown in FIGS. 1 and 5, the second connector 2 attached to the electrical circuit board at the upper surface thereof is placed at an upper position above the first connector 1 in a posture that the fitting block portion 52 of the second connector 2 faces downwardly. In the next step, the second connector 2 is lowered while maintaining the same posture. As a result, the fitting block portion 52 is inserted into the receiving recessed portion 27 of the movable housing 26 of the first connector 1, so that the fitting block portion 52 is fitted into the movable housing 26 (also referred to FIGS. 2 and 6).

When the second connector 2 is connected to the first connector 1, the contact portion 44 of the second terminal 40 of the second connector 2 sandwiches the contact portion 11A of the first terminal 10 of the first connector 1 as the contact portion 44 is formed of the contact pieces 44A with the finger shape. Accordingly, the contact portion 44 elastically contacts with the contact portion 11A with the specific holding force.

As described above, in the first embodiment, the contact portion 44 of the second terminal 40 includes the throat portion 44A-1 at the lower end portions of the contact pieces 44A with the finger shape. Accordingly, when the contact portion 11A with the flat band shape of the first terminal 10 is smoothly inserted into the throat portion 44A-1, the throat portion 44A-1 sandwiches the contact portion 11A of the first terminal 10 with an elastic force, so that the second terminal 40 is electrically connected to the first terminal 10.

Through the process described above, the first connector 1 is connected to the second connector 2. As a result, the electrical circuit board attached to the first connector 1 is electrically connected to the electrical circuit board attached to the second connector 2 through the first terminals 10 and the second terminals 40.

In the first embodiment, when the first connector 1 is started to connect to the second connector 2 (in the middle of the connecting operation), the contact portion 44 of the second terminal 40 sandwiches the contact portion 11A of the first terminal 10 with the elastic force (also referred to as a pressing sandwiching state). Further, when the first connector 1 is completely connected to the second connector 2, the pressing sandwiching state is maintained. As described above, within the elastic deformation range of the elastic portion 14 of the first terminal 10 in the vertical direction, the maximum spring force of the elastic portion 14 becomes smaller than the holding force generated in the pressing sandwiching state.

Accordingly, in the connector connection process, when the contact portion 11A of the movable side column portion 11 of the first terminal 10 is sandwiched with the contact portion 44 of the second terminal 40 with the holding force, the movable side column portion 11 of the first terminal 10 is moved downwardly together with the second terminal 40 while maintaining the contact position (the sandwiched position) relative to the contact portion 44, that is, without sliding the contact portion 11A against the contact portion 44. At this moment, the elastic portion 14 is elastically deformed downwardly, so that the movable side column portion 11 can be moved downwardly. Further, the movable housing 26 tightly holding the movable side column portion 11 is also moved downwardly together with the movable side column portion 11.

In the first embodiment, in the connector connection process, the movable housing 26 is moved downwardly until the recessed portion 29C of the movable housing 26 abuts against the regulating portion 34 of the regulating metal member 30. When the recessed portion 29C of the movable housing 26 abuts against the regulating portion 34 of the regulating metal member 30, the regulating portion 34 restricts the movable housing 26 from being moved further downwardly, so that the movable housing 26 does not abut against the electrical circuit board.

Further, when the recessed portion 29C of the movable housing 26 abuts against the regulating portion 34 of the regulating metal member 30, at least a part of the plate thickness of the regulating portion 34 is accommodated in the recessed portion 29C. When the regulating portion 34 is accommodated in the recessed portion 29C, the side edge of the regulating portion 34 is situated the step edge portion of the recessed portion 29C within the plate thickness thereof. Accordingly, the step edge portion of the recessed portion 29C abuts against the side edge of the regulating portion 34, so that the floating amount is restricted in the lateral direction in parallel to the bottom surface of the recessed portion 29C.

As described above, in the first embodiment, the fixed portion 31 of the regulating metal member 30 is tightly fitted in the holding groove portion 23A of the fixed housing 21. Further, the engaging protruding portions 31B and 31C of the regulating metal member 30 bit into the inner surface of the holding groove portion 23A. Accordingly, the regulating metal member 30 is securely positioned relative to the fixed housing 21. As a result, when the second connector 2 is pulled out and the regulating metal member 30 receives a force, the regulating metal member 30 does not come off the holding groove portion 23A.

Further, in the first embodiment, the cut portion 31A is formed in the fixed portion 31, so that the cut portion 31A engages with the protruding portion 23D formed on the inner surface of the holding groove portion 23A of the fixed housing 21. Accordingly, it is possible to prevent the fixed housing 21 from moving or being damaged against the force in the pulling out direction when the second connector 2 is pulled out.

Further, in the first embodiment, the regulating metal member 30 includes the supported portion 32 at the position corresponding to the regulating portion 34. Further, the supported portion 32 is supported with the supporting groove portion 23B of the fixed housing 21. Accordingly, when the regulating portion 34 restricts the movable housing 26 from being moved downwardly and the lateral portion 33 receives the force from the movable housing 26 to be twisted, the supported portion 32 supported with the supporting groove portion 23B receives the twisting force. Accordingly, it is possible to prevent the lateral portion 33 from being deformed.

In the first embodiment, when the recessed portion 29C of the movable housing 26 abuts against the regulating portion 34 of the regulating metal member 30, the elastic portion 14 is not elastically deformed downwardly any further. Accordingly, at this moment, the elastic deformation amount of the elastic portion 14 in the downward direction becomes the maximum amount within the elastic deformation range. As a result, when the second connector 2 is pushed down further from above after the recessed portion 29C of the movable housing 26 abuts against the regulating portion 34 of the regulating metal member 30, only the contact portion 44 of the second terminal 40 is moved downwardly without moving the movable side column portion 11 of the first terminal 10, that is, the contact portion 11A. Accordingly, the contact portion 44 is slid against the contact portion 11A.

Further, in the first embodiment, when the first connector 1 is completely connected to the second connector 2 in the connector connection process, the electrical circuit boards abut against a spacer (not shown) for securing a specific distance between the electrical circuit boards. In other words, at this moment, the first connector 1 and the second connector 2 are in the connector connected state. In the connector connected state, the recessed portion 29C of the movable housing 26 is maintained to abut against the lateral portion 33 of the regulating metal member 30, and the elastic portion 14 is maintained to deform downwardly with the maximum deformation amount.

Further, as shown in FIG. 2, in the connector connected state, there is a specific space in the vertical direction between the regulated protruding portion 26C of the movable housing 26 and the regulating surface 22C of the fixed housing 21. Further, in the connector connected state, the lower end portion of the fitting block portion 52 of the second connector 2 does not abut against the bottom surface of the receiving recessed portion 27 of the first connector 1, so that a specific space is created between the lower end portion of the fitting block portion 52 and the bottom surface of the receiving recessed portion 27.

Figure 8A:
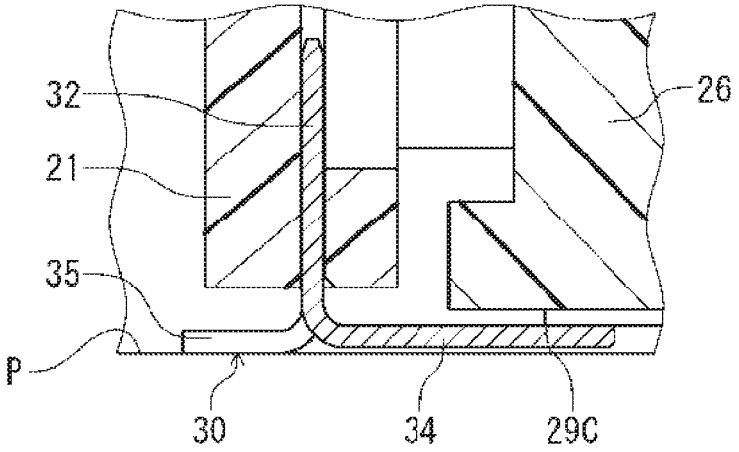
Figure 8B:
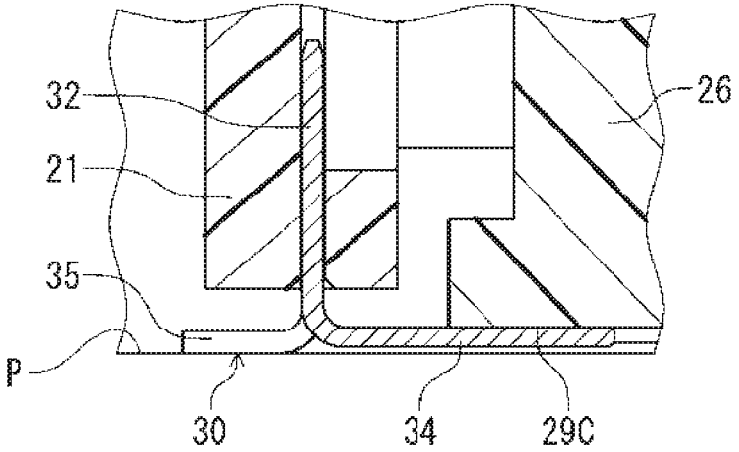
Figure 8C:
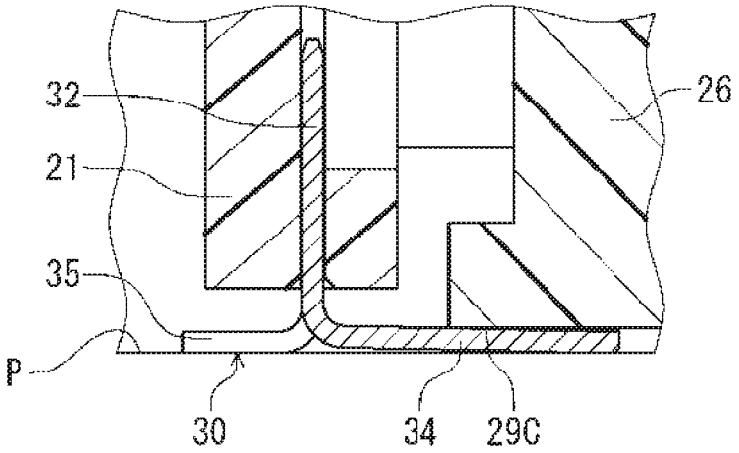

FIGS. 8(A) to 8(C) are sectional views showing the recessed portion 29C and the regulating portion 34 of the plug side connector 1 (the first connector 1) according to the first embodiment of the present invention. More specifically, FIG. 8(A) is a sectional view showing the recessed portion 29C and the regulating portion 34 of the plug side connector 1 before the recessed portion 29C abuts against the regulating portion 34. FIG. 8(B) is a sectional view showing the recessed portion 29C and the regulating portion 34 of the plug side connector 1 when the recessed portion 29C abuts against the regulating portion 34 without elastically deforming the regulating portion 34. FIG. 8(C) is a sectional view showing the recessed portion 29C and the regulating portion 34 of the plug side connector 1 when the recessed portion 29C abuts against the regulating portion 34 with elastically deforming the regulating portion 34.

In the first embodiment, when the recessed portion 29C of the movable housing 26 abuts against the regulating portion 34 of the regulating metal member 30, depending on a circumstance of the abutment, the recessed portion 29C of the movable housing 26 lightly abuts against the regulating portion 34 of the regulating metal member 30 and stops at the abutment position (case one), or the recessed portion 29C of the movable housing 26 strongly abuts against the regulating portion 34 of the regulating metal member 30 and the regulating portion 34 is temporarily and elastically deformed (case two).

In case one, the recessed portion 29C of the movable housing 26 lightly abuts against the regulating portion 34 of the regulating metal member 30 and stops at the abutment position. Accordingly, the regulating portion 34 restricts the recessed portion 29C from moving downwardly, and the recessed portion 29C stops and remains at the position of the regulating portion 34.

On the other hand, in case two, the recessed portion 29C of the movable housing 26 moves from the state shown in FIG. 8(A) to the state shown in FIG. 8(C) through the state shown in FIG. 8(B). In the state shown in FIG. 8(A), the recessed portion 29C of the movable housing 26 is away from the regulating portion 34 of the regulating metal member 30. In the state shown in FIG. 8(B), the recessed portion 29C of the movable housing 26 strongly abuts against the regulating portion 34 of the regulating metal member 30. In the state shown in FIG. 8(C), the recessed portion 29C of the movable housing 26 pushes downwardly the regulating portion 34 of the regulating metal member 30, so that the regulating portion 34 is elastically deformed and contacts with the electrical circuit board P.

Further, after the recessed portion 29C of the movable housing 26 pushes downwardly the regulating portion 34 of the regulating metal member 30 as shown in FIG. 8(C), the recessed portion 29C returns to the state shown in FIG. 8(B) because of the restoration force of the regulating portion 34, so that the state shown in FIG. 8(B) is maintained. It should be noted that the regulating portion 34 of the regulating metal member 30 may be arranged such that the regulating portion 34 abuts against the lower surface of the movable housing 26 before the first connector 1 is connected to the second connector 2.

Second Embodiment

Figure 9:
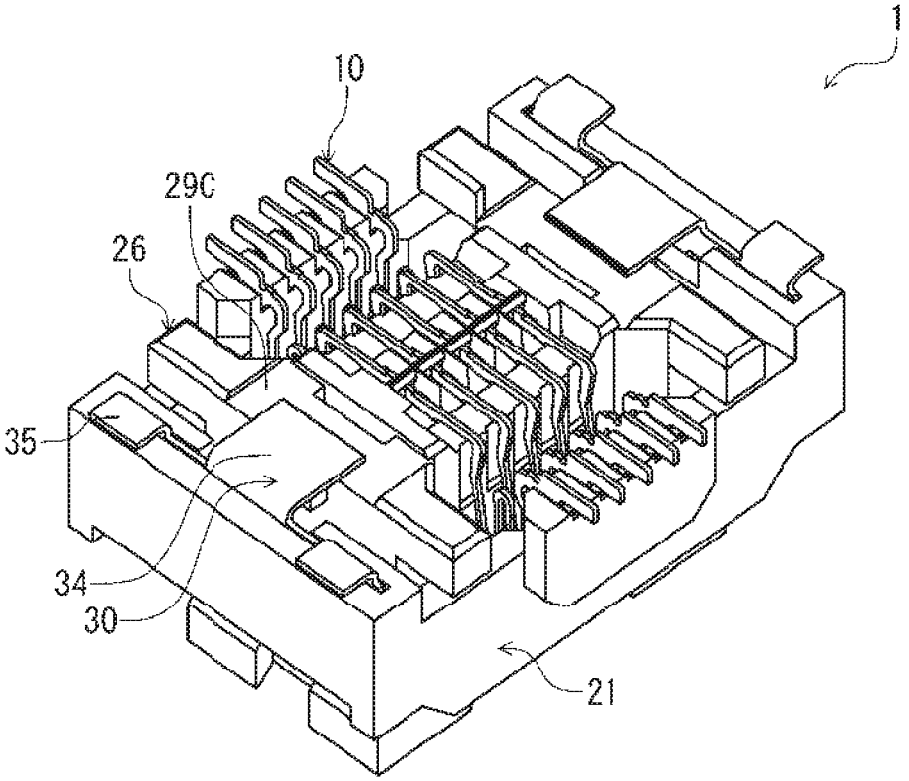
FIG. 9 is a perspective view showing the plug side connector (the first connector) of the connector assembled member according to a second embodiment of the present invention.

A second embodiment of the present invention will be explained next with reference to FIG. 9. FIG. 9 is a perspective view showing the plug side connector 1 (the first connector 1) of the connector assembled member according to the second embodiment of the present invention. In the first embodiment, the regulating metal member 30 is formed substantially in the triangular shape as shown in FIG. 3. In the second embodiment, the regulating metal member 30 is formed in a rectangular shape as shown in FIG. 9. Further, the recessed portion 29C of the movable housing 26 has the bottom surface having a rectangular shape.

As described above, in the second embodiment, the regulating metal member 30 is formed in the rectangular shape. Accordingly, the regulating metal member 30 abuts against the recessed portion 29C over a larger area. Further, the regulating metal member 30 has a greater strength. Further, it is possible to increase a length of the side edge portion of the regulating portion 34 and a length of the step edge portion of the recessed portion 29C. Accordingly, it is possible to restrict the floating amount in the lateral direction.

In the first embodiment and the second embodiment, the elastic portion 14 of the first terminal 10 is configured such that the elastic portion 14 is capable of elastically deforming not only in the vertical direction but also the connector longitudinal direction and the connector width direction. Accordingly, in the connector connection process and the connector connected state, even when the second connector 2 is shifted from a standard position or a standard posture in the vertical direction, the connector connection process, or the connector connected state, the elastic portion 14 is capable of absorbing the shift of the second connector 2.

The disclosure of Japanese Patent Application No. 2016-156115 filed on Aug. 9, 2016, is incorporated in the application by reference.

While the invention has been explained with reference to the specific embodiments of the invention, the explanation is illustrative and the invention is limited only by the appended claims.

What is claimed is:

1. An electrical connector comprising:

a terminal;

a housing for holding the terminal; and a regulating metal member comprising a lateral portion, a mounting portion extended outwardly from the lateral portion and a regulating portion extended inwardly from the lateral portion, wherein said terminal includes a connecting portion at one end portion thereof to be connected to an electrical circuit board and a contact portion at the other end portion thereof for contacting with a mating connecting member, said housing includes a fixed housing to be fixed to the electrical circuit board and a movable housing is fitted into the fixed housing and configured to be movable relative to the fixed housing, said regulating metal member is attached to the fixed housing, and the regulating portion preventing the movable housing from abutting against the electrical circuit board, said terminal further includes a fixed side held portion held in a protruding wall portion of the fixed housing, a movable side held portion held in the movable housing, and an elastic portion connecting the fixed side held portion and the movable side held portion positioned in between the fixed housing and the movable housing, and configured to be capable of elastically deforming, said regulating portion is disposed to abut against a lower surface of the fixed housing when the elastic portion of the terminal is elastically deformed and the movable housing is moved downwardly, and said movable housing includes a recessed portion in the lower surface thereof for accommodating at least a part of the regulating portion.

2. The electrical connector according to claim 1, wherein said regulating metal member further includes a mounting portion to be fixed to the electrical circuit board.

3. The electrical connector according to claim 1, wherein said fixed housing includes a holding groove portion extending upwardly from the lower surface of the fixed housing, said regulating metal member further includes a fixed portion to be fitted in the holding groove portion, and said fixed portion includes a cut portion for engaging with a corresponding protruding portion of the fixed housing when the mating connecting member is pulled out.

4. The electrical connector according to claim 1, wherein said fixed portion is disposed at a plurality of positions situated away from the regulating portion, said fixed housing includes a supporting groove portion extending upwardly from the lower surface of the fixed housing, said regulating metal member includes a supported portion to be tightly fitted in or inserted into the supporting groove portion of the fixed housing, and said supported portion is disposed at a position same as that of the regulating portion or a position overlapping with that of the regulating portion in a direction connecting base portions of a plurality of the fixed portions.

* * * * *